United States Patent [19]

Umemura et al.

[11] Patent Number: 4,909,310

[45] Date of Patent: Mar. 20, 1990

[54] AIR FLOW CONTROL DEVICE FOR AN AIR CONDITIONER

[75] Inventors: Hiroyuki Umemura; Kenji Togashi; Kenji Matsuda; Tetsuji Okada; Hidenori Ishioka; Katsuyuki Aoki, all of Shizuoka; Sakuo Sugawara; Masanori Hara, both of Kamakura, all of Japan

[73] Assignee: Mitsubishi Denki Kabushiki Kaisha, Tokyo, Japan

[21] Appl. No.: 204,280

[22] Filed: Jun. 9, 1988

[30] Foreign Application Priority Data

Sep. 3, 1987 [JP] Japan ..... 62-220773

[51] Int. Cl.[4] ..... B60H 1/00; B61D 27/00; F25D 17/06

[52] U.S. Cl. ..... 165/40; 165/127; 98/31.6; 62/186; 236/38

[58] Field of Search ..... 165/40, 122, 127; 98/31.6; 62/186; 236/38

[56] References Cited

U.S. PATENT DOCUMENTS 4,522,255 6/1985 Baker ..... 165/122
4,615,481 10/1986 Tanaami et al. ..... 236/38

FOREIGN PATENT DOCUMENTS 0112515 11/1983 European Pat. Off. .
191842 10/1984 Japan .
0000230 1/1985 Japan ..... 236/38
2199935 7/1988 United Kingdom .

*Primary Examiner*—John Ford
*Attorney, Agent, or Firm*—Oblon, Spivak, McClelland, Maier & Neustadt

[57] ABSTRACT

In an air flow control device for an air conditioner including a heat exchanger arranged so as to face an inlet port, and upper and lower air-blowing fans disposed in upper and lower outlet ports, respectively, wherein air sucked through the inlet port and the heat exchanger is directed to the fans, there are further provided input producing means for outputting a condition required for the outlet air from the outlet ports and phenomenon information on the outlet air, upper and lower fan operation mode determining means for determining the operation modes depending on the output signals from the input producing means, upper and lower fan operation mode control means for controlling the operation of both fans at the operation mode according to the commands from the operation mode determining means, and control means for optimizing the outlet air to a user.

1 Claim, 8 Drawing Sheets

AIR FLOW CONTROL DEVICE FOR AN AIR CONDITIONER

BACKGROUND OF THE INVENTION

1. FIELD OF THE INVENTION

The present invention relates to an air flow control device for a wall-mounted air conditioner with an upper outlet port and a lower outlet port. In particular, it relates to an air flow control device capable of optimizing temperature of the conditioned air blown out from the room side unit, which affects the sense of a user who is at a lower position than the mounting level of the wall-mounted room side unit.

2. DISCUSSION OF BACKGROUND

FIG. 13 is a vertical sectional view showing the room side unit in a conventional air conditioner as, for example, disclosed in Japanese Unexamined Patent Publication No. 191842/1984. In FIG. 13, reference numeral 1 designates an upper air-blowing fan (crossflow fan) which is disposed at an upper portion in the room side unit. Reference numeral 2 designates a lower air-blowing fan (crossflow fan) which is disposed at a lower portion in the room side unit. Reference numeral 3 designates a room side heat exchanger which is arranged between the upper air-blowing fan 1 and the lower air-blowing fan 2. Reference numeral 4 designates an upper outlet port which is formed in a upper front portion of the room side unit, and reference numeral 5 designates a lower outlet port which is formed in a lower front portion of the room side unit. Reference numeral 6 indicates the flow of the conditioned air which is blown out from both ports 4 and 5 by means of both fans 1 and 2 after the air in the room has been sucked through the room side heat exchanger 3.

FIG. 14 is a block diagram showing an air-blowing fan control system which is provided in the room side unit of the conventional air conditioner as shown in FIG. 13. Reference numeral 11 designates air-blowing fan operation mode determining means for determining the operation mode of both fans; 12, air-blowing fan operation control means for controlling the operations of both fans in accordance with the operation mode determined by the operation mode determining means 11; 14, heat exchanger temperature detecting means; 15, outlet port air temperature detecting means. Reference numeral 16 designates load calculating means for calculating a load based on the detected temperature signal from the heat exchanger temperature detecting means 14 or the detected temperature signal from the outlet port air temperature detecting means 15 so as to feed the results of the calculation to the operation mode determining means 11.

The operation of the air-blowing fan control system will be described in reference to FIG. 15 wherein the operation modes of the fans and the temperatures of the heat exchanger are shown in graphical representations.

When "heating" operation starts, both fans 1 and 2 maintain their OFF mode as shown in FIG. 15 at (a) and (b) until the temperature of the heat exchanger 3 reaches a preset value A, because the temperature of the heat exchanger 3 is lower than that value immediately after the "heating" operation has started. When the temperature of the heat exchanger 3 reaches the value A as shown in FIG. 15 at (c), the upper air-blowing fan 1 is driven in its low speed mode. When the temperature of the heat exchanger reaches a preset value B, the fan 1 is driven in its high speed mode. In addition, when the temperature of the heat exchanger 3 rises to a preset value C, the lower blowing fan 2 is driven in its low speed mode. When the temperature reaches a preset value D, the lower blowing fan 2 is driven in its high speed mode.

Now, the operation of the system will be explained in reference to FIG. 14. The detection temperature signal from the heat exchanger temperature detecting means 14 or the detection temperature signal from the outlet air temperature detecting means 15 is fed to the load calculating means 16 to calculate the load condition. The load signal representing the calculated load condition is fed to the fan operation mode determining means 11 to determine the operation modes of both fans depending on the load signal. The determined operation modes are instructed to the control means 12 for controlling the operations of both fans. As a result, the control means 12 controls both fans 1 and 2 in accordance with the instructed operation modes.

In the conventional air conditioner, when both fans are driven at substantially the same revolution, the upper and lower outlet ports 4 and 5 blow out at substantially equal wind volume the air that has passed through the heat exchanger 3.

When the wall-mounted room side unit carries out the "heating" operation and a sufficient volume of the heated air is blown out of the respective outlet ports 4 and 5, the heated air from the upper outlet port 4 holds down the heated air from the lower outlet port 5 to prevent the heated air from the lower outlet 5 from rising. It allows the heated air to circulate around the user's feet and legs and to provide comfortable air-conditioned atmosphere without uneven distribution in the temperature.

The conventional air conditioner carries out the operation control of both fans, depending on the load conditions being calculated based on the heat exchanger temperature or the outlet air temperature as shown in FIG. 15. As a result, when the air conditioner is wall-mounted so as to have both outlets at positions higher than the user, it does not always provide comfortable air circulation to the user, an it also has a disadvantage in terms of energy-saving because it wastefully heats the upper space in the room.

When the wind rates at both fans are set to a "strong wind" mode and sufficient volumes of the conditioned air are provided from the fans, it is possible to obtain air-conditioning without uneven distribution in the temperature. When the wind rates are set to a "weak wind" mode and the conditioned air passing through the heat exchanger is distributed to both outlet ports, the conditioned air blowing out of the lower outlet port is difficult to reach the user's feet and legs. In particular, at the "heating" operation, the heated air from the upper outlet port can not hold down the heated air from the lower outlet port. As a result, the heated air from the lower outlet port can not circulate in a good manner to cause uneven distribution in the temperature, thereby having a disadvantage that the user's feet and legs are not heated.

In addition, when the user who comes into the conditioned room from outside wishes a "spot-heating" or a "spot-cooling" operation wherein the user wants to heat or cool his or her body exclusively the conventional air conditioner has a further disadvantage in that it is difficult to use effectively the conditioned air from one of the outlet ports.

It is an object of the present invention to eliminate the disadvantages in the conventional air conditioner as explained above.

It is another object of the present invention to provide an air flow control device for an air conditioner capable of carrying out optimum controls of the conditioned air blown out of the outlet ports so that the user who is at a lower level than the mounting level of the wall-mounted air conditioned can feels good comfort, and provide optimum comfortable atmosphere, depending on the user's desires.

The foregoing and the objects of the present invention have been attained by providing an air flow control device for an air conditioner comprising input producing means for outputting a condition required for the outlet air and phenomenon information on the outlet air, control means for controlling at least upper and lower air-blowing fans based on the condition and phenomenon information outputs from the input producing means so as to optimize the outlet air to the user who is at a lower level than the outlet level.

In accordance with the present invention, when the outlet air conditions (namely, selection among the "strong wind" mode, the "weak wind" mode and the spot mode) and the phenomenon information on the outlet air (namely, temperature information on the air from the lower outlet port) are sent from the input producing means into the control means, the control means controls mainly both fans so that the atmosphere where the user is experiences comfortable air conditioning.

As a result, the present invention can carry out optimum controls of the outlet air and also provide comfortable atmosphere as the user wishes.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Now, the present invention will be described in more detail in reference to the accompanying drawings.

Figure 1:
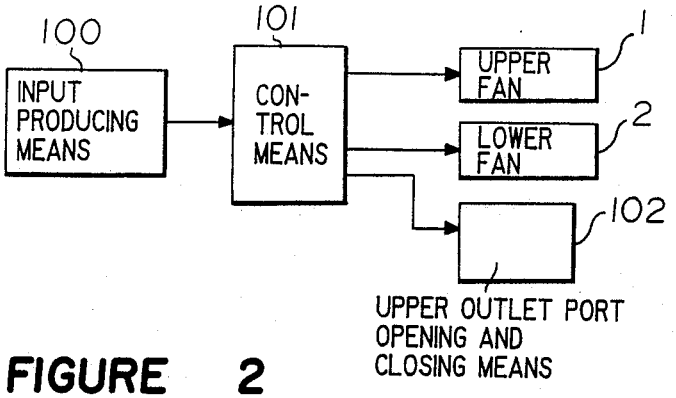
FIG. 1 is a block diagram showing the principle of the air flow control device according to the present invention.

FIG. 1 is a block diagram showing the principle of the air-blowing control device according to the present invention. Reference numeral 100 designates input producing means for outputting conditions required for the outlet air and phenomenon information on the outlet air. Reference numeral 101 designates control means for controlling both fans 1 and 2 or a damper 102 provided in the upper outlet port, based on the required condition output and the phenomenon information output from the input producing means 100 so as to adjust the outlet air to a user who is at a lower level than the outlet air blowing level.

In the air flow control device as constructed above, when the phenomenon information on the outlet air (namely the temperature information on the air blown out of the lower outlet port) is sent from the input producing means 100 into the control means 101, the control means 101 carries out mainly the operation of the lower fan 2, depending on the outlet air temperature so as to provide comfortable atmosphere to the user who is at a lower level than the outlet port of the air conditioner.

When the condition required for the outlet air is set to the "strong wind" mode or the "weak wind" mode in the input producing means 100, the control means 101 controls the driving operations of both fans 1 and 2, or the driving operation of the lower blowing fan 2 and the opening and closing operation of the damper 102 automatically, depending on the set wind rate, so that the user can obtain optimum distribution in temperature around himself or herself.

When the "spot-heating" or the "spot-cooling" mode is set as the condition required for the outlet air in the input producing means 100, the control means 101 carries out the driving operation of the lower fan 2 to blow the conditioned air from the lower outlet port 5 exclusively. As a result, the user can enjoy a comfortable atmosphere around himself or herself as the user wishes.

Specific embodiments based on the principle of the present invention will be explained.

Figure 2:
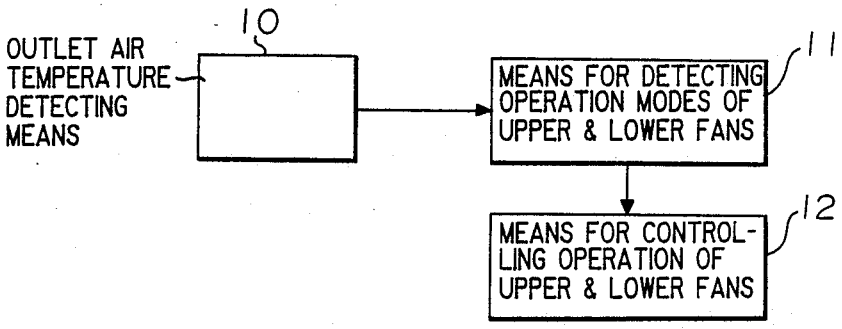
FIG. 2 is a block diagram showing the essential functions in an embodiment of the air flow control device according to the present invention.
Figure 3:
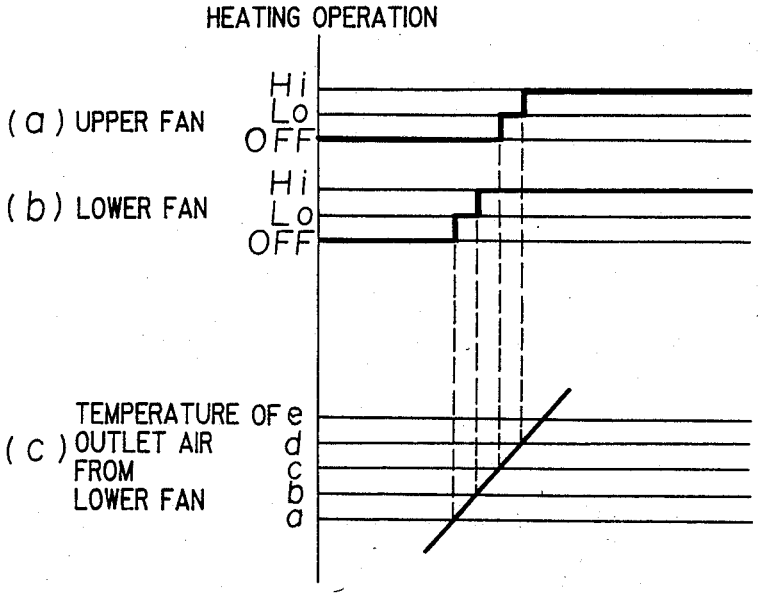
FIG. 3 is a graphical representation showing the operations of the fans and the outlet air temperatures of the lower air-blowing fan in the operation control for the device shown in FIG. 2.

FIGS. 2 and 3 are a first embodiment of the present invention, where FIG. 2 is a block diagram showing the essential parts of the air flow control device according to the present invention, and FIG. 3 is a graphical representation showing the operations.

In FIG. 2, reference numeral 10 designates outlet air temperature detecting means for detecting temperature in the outlet air blowing out of the lower outlet 5, which corresponds to the input producing means 100 as shown in FIG. 1. The output signal on the detected temperature from the outlet air temperature detecting means is fed to operation mode determining means 11 for both fans, and operation mode commands are output from the operation mode determining means 11 to control means 12 for controlling the operations of both fans.

The room side unit in the air conditioner can have a similar structure to that of the conventional air conditioner.

The operations of the air flow control device of the air conditioner as constructed above will be explained in reference to the graphical representation shown in FIG. 3 at (a)–(c).

When the power is turned on to start the operation, first, the outlet air temperature detecting means 10 detects the temperature in the outlet air blown out of the lower outlet port 5 by the lower fan 2. The output signal indicative of the temperature detected by the outlet air temperature detecting means 10 is fed to the operation mode determining means 11 to be used as data for determining the operation mode.

When the outlet air that is blown out of the lower outlet port by the lower fan 2 at the time of starting the operation of the air conditioner has a temperature lower than a preset value a as shown in FIG. 3 at (c), the operation mode determining means 11 maintains both fans 1 and 2 off. When the outlet air temperature at the time of starting the operation is between the preset value a and a preset value b as shown in FIG. 3 at (c), the operation mode determining means 11 drives only the lower fan 2 at a low speed mode as shown in FIG. 3 at (b). When the temperature of the outlet air that is blown out of the lower outlet port at the time of starting the operation is between the preset value b and a preset value c, the operation mode determining means 11 drives only the lower fan 2 at a high speed mode. When the temperature of the outlet air that is blown out of the lower outlet at the time of starting the operation is between the preset value c and a preset value d, the operation mode determining means 11 drives the upper blowing fan 1 at a lower speed mode while driving the lower fan 2 at the higher speed mode. When the temperature of outlet air that is blown out of the lower outlet at the time of the starting the operation is between the preset value d and a preset value e, the operation mode determining means 11 drives both fans 1 and 2 at the higher speed modes.

These preset values (a) to (e) are stored in the memory for the operation mode determining means 11 at the time of production so that they are a higher temperature in sequence.

In accordance with the first embodiment, the operations of both fans can be carried out depending on the outlet air temperature from the lower outlet port, which has significant influence on the sense of comfort of the user, thereby allowing the atmosphere around the user to become comfortable.

Although the first embodiment has been explained only in the case that the rotations of both fans are step-controlled, the stepless rotation control as generally known can be adopted.

Figure 4:
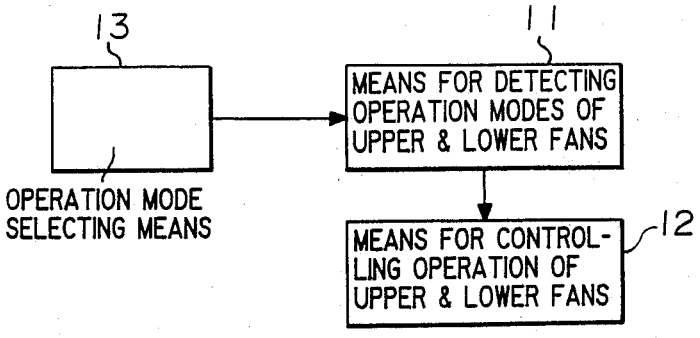
FIG. 4 is a functional block diagram showing the essential parts of a second embodiment of the air flow control device.

A second embodiment will be explained. FIG. 4 is a block diagram showing the essential functions of the second embodiment, wherein the same reference numerals as FIG. 1 designate similar parts. The second embodiment as shown in FIG. 4 is different from the first embodiment as shown in FIG. 1 in that in order to determine the operation mode of both fans, there is provided operation mode selecting means 13 in place of the lower outlet air temperature detecting means. The operation mode selecting means 13 enables the user to select either the "spot-heating" mode wherein the air conditioner heats a local spot in the room or the "room-heating" mode wherein the air conditioner heats the entire inside of the room.

Figure 5:
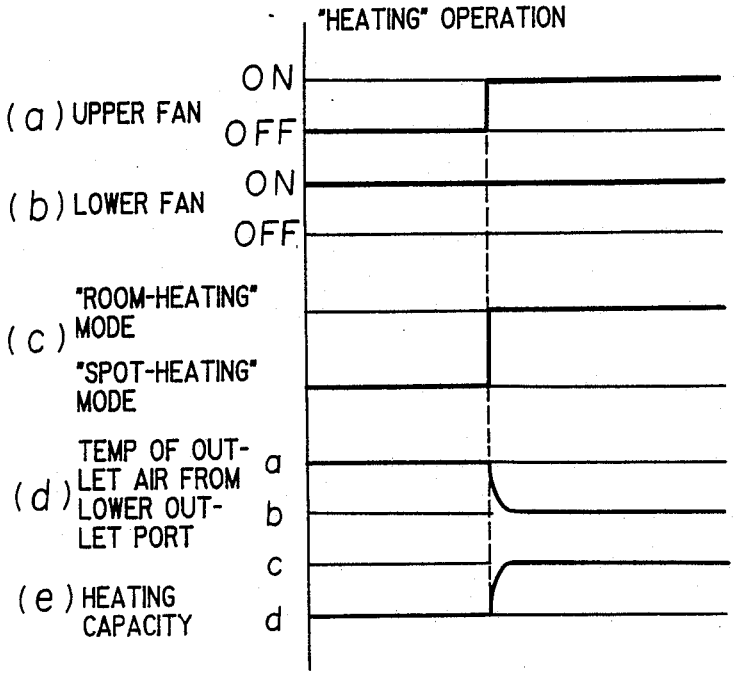
FIG. 5 is a graphical representation showing the operation of the embodiment shown in FIG. 4.

As shown in FIG. 5, in the "spot-heating" mode, the control device drives only the lower fan 2 to feed the heated air from the lower outlet port so as to provide a sense of comfort for the user while restraining the heating capacity. In the "room-heating" mode, the control device drives both fans to uniformly heat the entire inside of the room with sufficient heating capacity. As a result, the control device can provide an efficient heating operation. In accordance with the second embodiment, since the user can optionally select either the "heating" mode or "room-heating" mode of both fans, a quite comfortable and efficient heating operation can be obtained.

Next, a third embodiment will be explained in reference to FIGS. 6 through 9. In the third embodiment, in accordance with the set wind rate, simultaneous operations of both fans or sole operation of the lower fan is automatically carried out.

Figure 6:
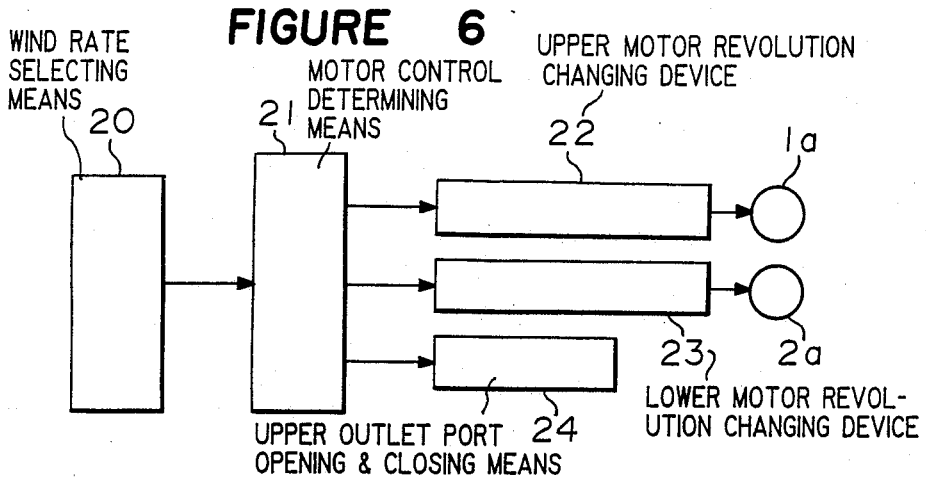
FIG. 6 is a basic block diagram showing an air flow control system in the air conditioner of a third embodiment.

FIG. 6 is the block diagram showing the basic structure of air flow control device capable of realizing the above-mentioned functions. In FIG. 6, reference numeral 20 designates wind rate selecting means for setting a wind rate (namely, the "strong wind" mode or the "weak wind" mode) that the user wishes, which corresponds to the input producing means 100 as shown in FIG. 1. Reference numeral 21 designates motor control determining means for determining the operations of both fans and a damper motor based on an instruction signal from the wind rate selecting means 20. Reference numerals 22 and 23 designate an upper motor rotation changing device and a lower motor rotation changing device, respectively, which are operated by determination commands (namely speed signals including driving and stopping) from the motor control determining means 21. The upper motor rotation changing device 22 is connected to an electric motor 1*a* for the upper blowing fan. The lower motor rotation changing device 23 is connected to an electric motor 2*a* for the lower blowing fan. Reference numeral 24 designates opening and closing means for carrying out the opening and closing operations of the upper outlet port based on the determination commands from the motor control determining means 21.

The motor control determining means 21, the upper and lower motor rotation changing devices 22 and 23, and the opening and closing means 24 correspond to the control means 101 as shown in FIG. 1.

In the air flow control device as constructed above, when the wind rate selecting means 20 is set to the "strong wind" mode, the motor control determining means 21 which has received a corresponding command from the wind rate selecting means output an operational command and a speed signal to the upper motor rotation changing device 22 and the lower motor rotation changing device 23 so as to drive the electric motors 1*a* and 2*a* for both fans at predetermined speeds. At the same time, the motor control determining means 21 sends an opening command to the opening and closing means 24 to open the upper outlet port 4 of the room side unit.

Since both fans 1 and 2 in the room side unit are simultaneously driven at the time of selecting the "strong wind" mode, the outlet air from the upper outlet port holds down the outlet air from the lower outlet port to make the lower outlet air circulate effectively, thereby providing comfortable atmosphere without uneven distribution in the temperature around the user who is at a lower level than the outlet port level of the room side unit.

On the other hand, when the wind rate selecting means 20 is set to the "weak wind" mode, the motor control determining means 21 outputs a stoppage command to the upper motor rotation changing device 22 to stop the electric motor 1*a* for the upper fan from driving and sends a closing command to the opening and the closing means 24 to close the upper outlet port 4 in the room side unit. At this time, the motor control determining means 21 sends a driving command and a speed command to the lower motor rotation changing device 23 to drive the motor 2*a* for the lower fan at a predetermined speed.

As a result, sole driving operation of the lower fan 2 allows the heated air (or cooled air) from the lower outlet port 5 to reach the user's feet and legs effectively, thereby providing comfortable atmosphere around the user.

Figure 7:
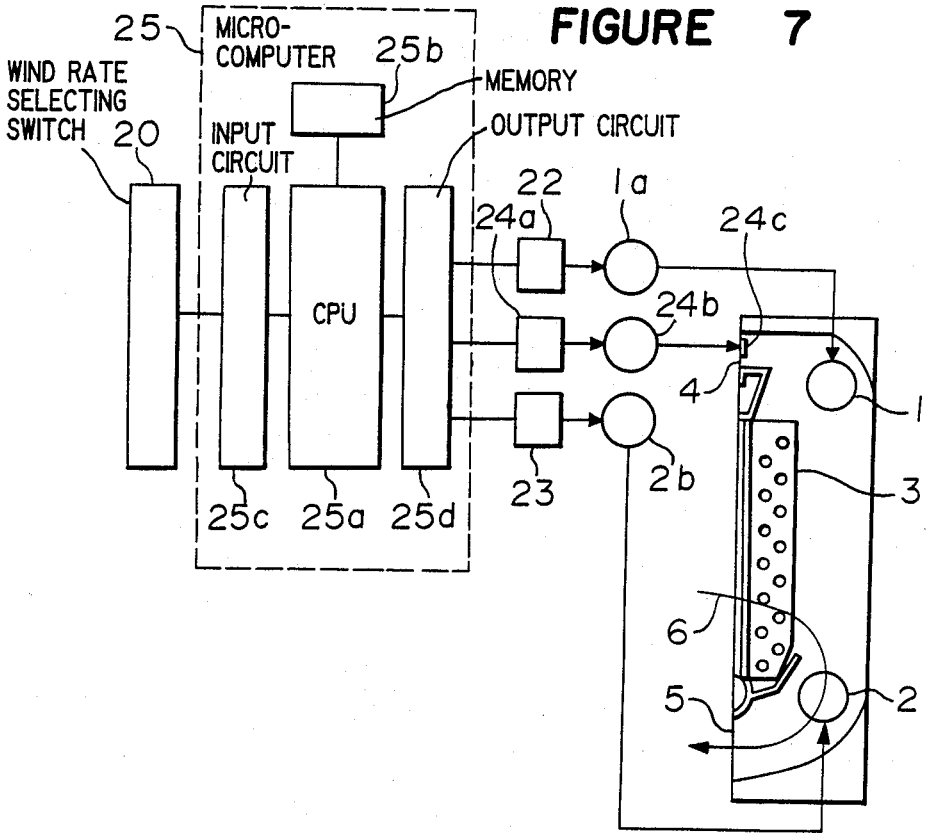
FIG. 7 is a block diagram showing the overall structure of the embodiment as shown in FIG. 6 in more detail.

FIG. 7 shows an embodiment wherein the air flow control system of the third embodiment as shown in FIG. 6 is constituted using a microcomputer.

In FIG. 7, the microcomputer 25 constituting the motor control determining means comprises a CPU (central processing unit) 25*a*, a memory 25*b* for storing the results calculated in the CPU 25*a* and a program for controlling the outlet air, and the like, an input circuit 25*c* for transmitting the wind rate setting commands from the wind rate selecting switch (the wind rate selecting means) 20 to the CPU 25*a*, and an output circuit 25*d* for outputting control commands obtained by program execution to the fans and the opening and closing means. The output circuit 25*d* is connected to the upper motor rotation changing device 22, the lower motor rotation changing device 23 and a relay 24*a* constituting the opening and closing means 24.

The opening and closing means 24 is constituted by the relay 24*a* whose energizing time is controlled by the microcomputer 25, a damper motor 24*b* whose rotation angle is controlled depending on the energizing time, and a damper 14*c* which is controlled by the damper motor to carry out opening and closing operation of the upper outlet port.

Figure 13:
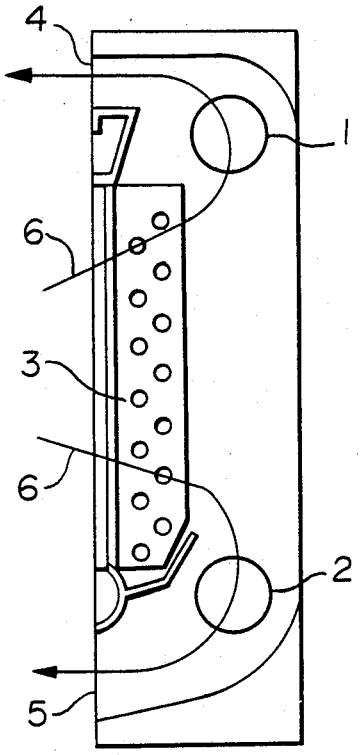
FIGURE 13 PRIOR ART
FIG. 13 is a vertical cross sectional view showing the room side unit in the conventional air conditioner.
Figure 14:
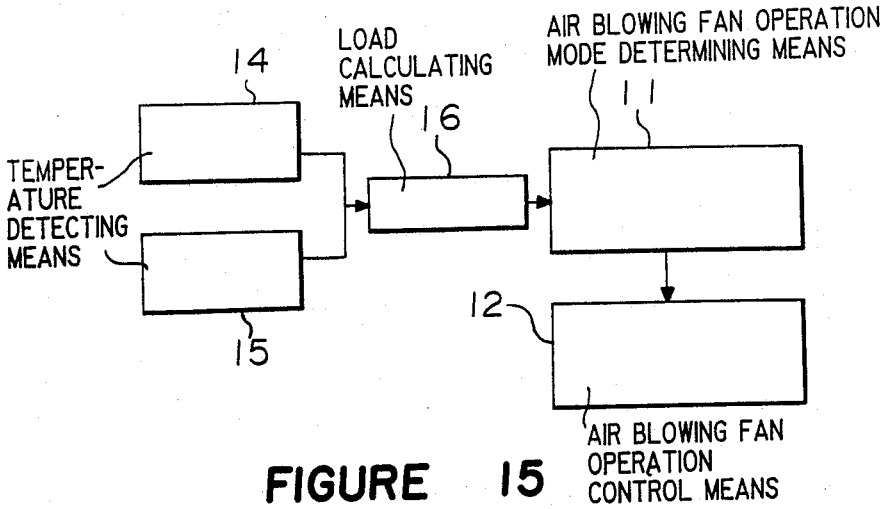
FIGURE 14 PRIOR ART
FIG. 14 is a functional block diagram showing the conventional air conditioner.
Figure 15:
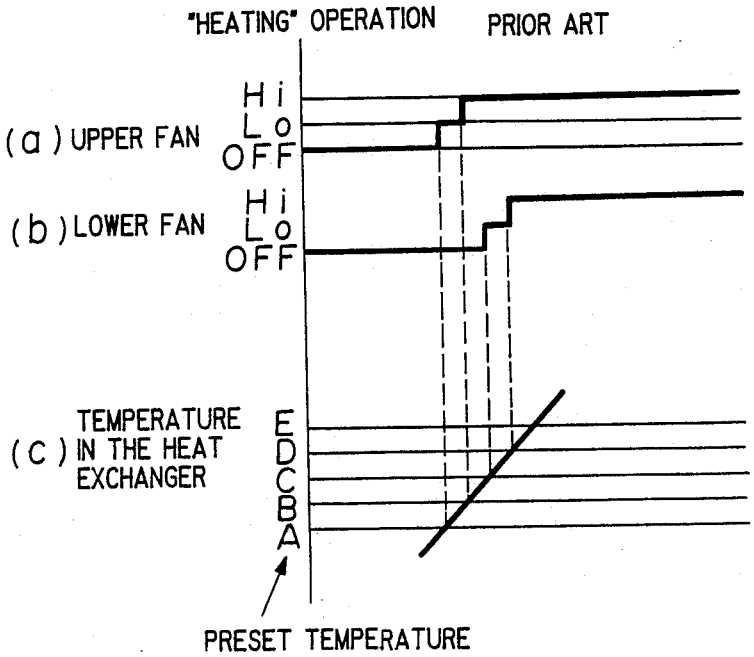
FIGURE 15 PRIOR ART
FIG. 15 is a graphical representation explaining the operations in the air conditioner shown in FIG. 14.

The wind rate selecting switch 20 enables the user to select the "strong wind" mode giving great volume of wind which is selected when high capacity is required though it is noisy. In FIG. 7, the same reference numerals as FIG. 13 designates similar parts.

The operation of the embodiment as constructed above is next explained.

First, the user sets a desired wind rate by the wind rate selecting switch 20. An command signal indicative of the set wind rate as desired by the user is transmitted into the microcomputer 25. The microcomputer 25 determines the driving or stopping of both fans 1 and 2, the revolution of the fan to be driven, and the opening or closing of the damper in the upper outlet port, depending on the set wind rate command. A program for determining these controls is stored in the memory 25*b*. The program is decoded and executed by the CPU 25*a* to carry out the air flow control depending on the set wind rate. Now, the operation will be explained in reference to FIG. 8.

Figure 8:
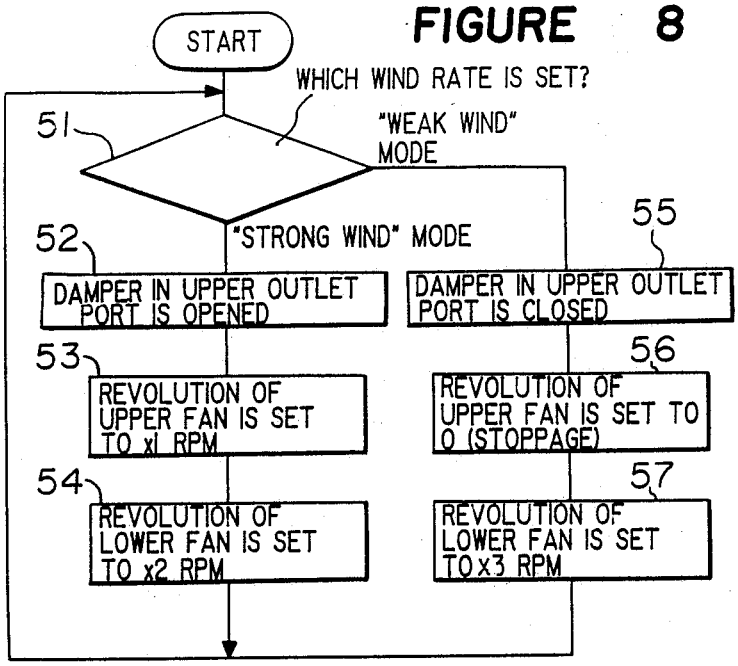
FIG. 8 is a flow chart for explaining the operations of motor control determining means in the third embodiment.

When the program as shown in FIG. 8 starts to be executed, it is determined whether the wind rate set by the wind rate selecting switch 20 is the "strong wind" mode or the "weak wind" mode at a step 51. If it is determined that the "strong wind" mode is set in the wind rate selecting switch 20, the relay 24*a* is energized for a definite time to drive the damper motor 24*b* so as to open the damper 24*c* in the upper outlet port 4 at the next step 52. At the next step 53, the revolution of the upper fan 1 is set to $x_1$ rpm. At the next step 54, the revolution of the lower fan 2 is set to $x_2$ rpm. Thus, both fans 1 and 2 are simultaneously driven with said revolutions while the damper 24*c* in the upper outlet port 4 is open.

As a result, the outlet air from the upper outlet port 4 holds down the outlet air from the lower outlet port to allow the latter to be circulated effectively, thereby providing comfortable atmosphere without uneven distribution in the temperature for the user who is at a lower position than the outlet ports of the wall-mounted room side unit.

On the other hand, if at the step 51 it is determined that the "weak wind" mode is set in the wind rate selecting switch 20, the relay 24 and the damper motor 24*b* are controlled to close the damper 24*c* in the upper outlet port 4. At the next step 56, the revolution of the upper fan 1 is set to zero, or stoppage. At the next step 57, the revolution of the lower fan 2 is set to $x_3$ rpm. Thus, only the lower fan 2 is driven with the set revolution while the damper 24*c* closes the upper outlet port 4.

As a result, when the "weak wind" mode is set, the outlet air is blown out of only the lower outlet port 5. In the "heating" mode with the "weak wind" mode, it is ensured that the heated air reach the user's feet and legs. It is possible to obtain comfortable atmosphere around the user by low noise and small volume of the blown wind.

Figure 9:
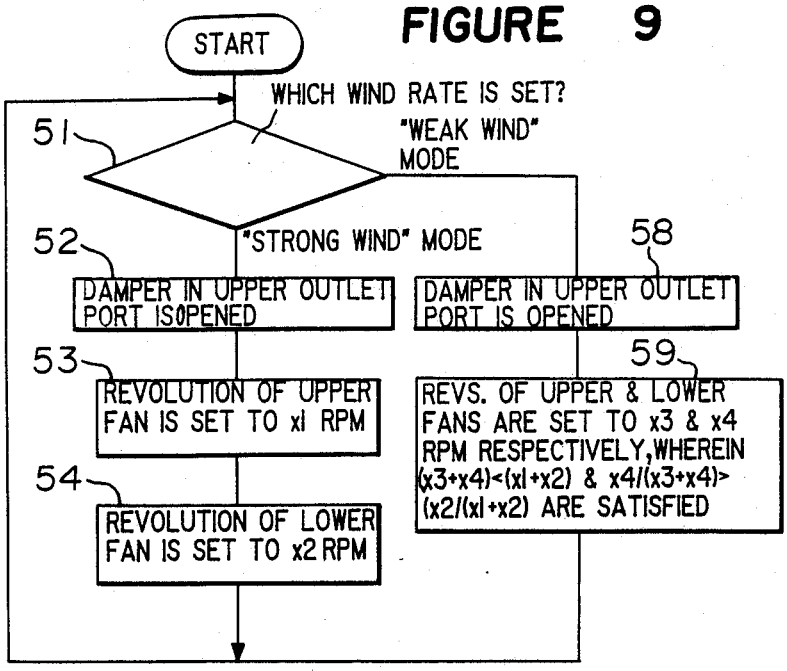
FIG. 9 is a flow chart showing a modified embodiment of the air flow control in the third embodiment.

Although in the embodiment as explained just above, the upper fan is stopped when the "weak wind" mode is set, air flow control represented by the flow chart as shown in FIG. 9 wherein the upper fan is not stopped can be adopted.

In FIG. 9, when the "strong wind" mode is set, the same processing as shown in FIG. 8 is carried out. When the "weak wind" mode is set, processing different from that of FIG. 8 is executed.

If at the step 51 it is determined that the "weak wind" mode is set, the damper 24*c* in the upper outlet port is opened at a step 58. At the next step 59, the revolutions of the upper and lower fans 1 and 2 are set to $x_3$ rpm and $x_4$ rpm, respectively. The values of $x_3$ and $x_4$ are decided so that the sum of $(x_3+x_4)$ is smaller than the sum of $(x_1+x_2)$ to decrease the total volumes of the blown air and so that the ratio of the revolution of the lower fan 2 to the sum of the revolutions of both fans at the "weak wind" mode, i.e. $x_4/(x_3+x_4)$ is greater than the ratio of the revolution of the lower fan 2 to the sum of the revolutions of both fans at the "strong wind" mode, i.e. $x_2/(x_1+x_2)$.

While both fans 1 and 2 are being driven, the total volume of the blown air is decreased and the air volume ratio of the lower fan 2 is increased to drive the lower fan more strongly than the upper fan. In comparison with the case that the upper fan 1 is stopped, the volume of the air blown out of the lower outlet port with the same noise level is decreased. However, in comparison with the case that the total volume of the blown air is reduced maintaining the same ratio of the blown air out of both outlet ports, the heated air from the lower fan 2 can arrive at a further distance and the temperature distribution at the "weak wind" mode is improved. In addition, the means for opening and closing the upper outlet port can be eliminated because the damper in the upper outlet port 4 can continuously opened.

Next, a fourth embodiment of the present invention will be described in reference to FIGS. 10 through 12. In this embodiment, it is possible to optimize conditioned atmosphere at a "normal mode" and a "spot mode" which are selected depending on the user's wish.

Figure 10:
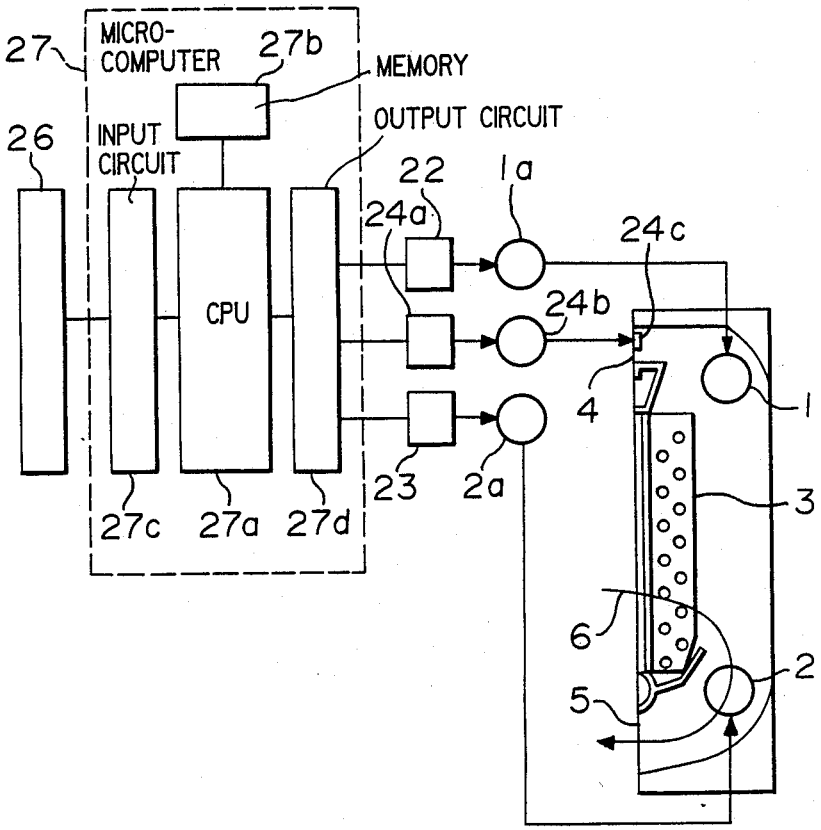
FIG. 10 is a block diagram showing the overall structure of the air-blowing control device as a fourth embodiment.

FIG. 10 shows the entire structure of the air flow control device which can realize the functions as just above mentioned. Reference numeral 26 designates an operation mode selecting switch corresponding to the input producing meas 100 as shown in FIG. 1, which enables the user to select the "normal mode" wherein the entire inside of the room is uniformly heated or cooled, or the "spot mode" wherein the conditioned air is blown to the user exclusively. Reference numeral 27 designates a microcomputer corresponding to the motor control determining means as shown in FIG. 6, which comprises a CPU (central processing unit) **27*a*, a memory 27*b* for storing the results of the calculation in the CPU 27*a* and a program for carring out the air flow control at the "normal mode" and the "spot mode", and the like, an inputs circuit 27*c* for transmitting operation mode commands from the operation mode selecting switch 26 into the CPU 27*a*, and an output circuit 27*d* for outputting control commands given by the execution of the program to the fans and upper outlet port opening and closing means. The output circuit 27*d* is connected to an upper motor revolution changing device 22, a lower motor revolution changing device 23 and a relay 24*a*** constituting the upper outlet port opening and closing means.

The upper outlet port opening and closing means is constituted by the relay **24*a* whose energizing time is controlled by the microcomputer 27, a damper motor 24*b* whose rotation angle is controlled depending on the energizing time, and a damper 24*c* which is controlled by the damper motor 24 to open and close the upper outlet port 4. The microcomputer 27, the upper and lower motor revolution changing devices 22 and 23, and the upper outlet port opening and closing means constitute the control means 101 as shown in FIG. 1**.

In FIG. 10, the same reference numerals as FIG. 7 designate similar parts.

The operation of the embodiment as constructed above will be explained.

First, the user selects with the operation mode selecting switch 26 whether he or she wishes to cool (heat) the entire inside of the room or to cool (heat) the atmosphere around himself or herself. The operation mode command indicative of the user's wish is transmitted into the microcomputer 27. The microcomputer 27 determines the driving or stopping of both fans 1 and 2, the revolution of the fan to be driven and the opening or closing of the damper in the upper outlet port 4, in accordance with the transmitted operation mode command. A program for carrying out these control determinations are stored in the memory **27*b*. The program is decoded and executed by the CPU 27 to carry out the air flow control depending on the set wind rate. Now, the operation will be explained in reference to FIG. 11**.

Figure 11:
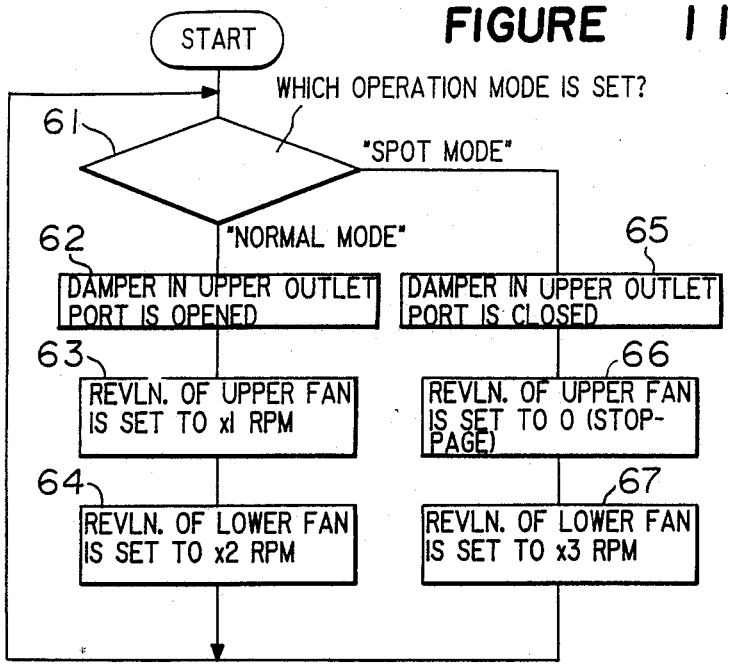
FIG. 11 is a flow chart for explaining the operations of the air-blowing control device as shown in FIG. 10.

When a program as shown in FIG. 11 starts to be executed, it is determined whether the operation mode set by the operation mode switch 26 is the "normal mode" or the "spot mode", at a step 61. If it is determined that the "normal mode" is set, the relay **24*a* is energized for a definite time to drive the damper motor 24*b* so as to open the damper 24*c* in the upper outlet port 4 at the next step 62. At the next step 63, the revolution of the upper fan 1 is set to $x_1$ rpm. At the next step 64, the revolution of the lower fan 2 is set to $x_2$ rpm. Thus, both fans 1 and 2 are simultaneously driven at the set revolutions while the damper 24*c* is opened in the upper outlet port 4**.

As a result, the outlet air from the upper outlet port 4 holds down the outlet air from the lower outlet port, which allows the latter to be circulated effectively, thereby providing comfortable atmosphere without uneven distribution in the temperature around the user who is at a lower position than the outlet ports of the wall-mounted room side unit. That is to say, it is possible to cool or heat the entire inside of the room uniformly.

On the other hand, if at the step 61, it is determined that the "spot mode" is selected, the relay **24*a* and the damper motor 24*b* are controlled so as to close the damper 24*c* in the upper outlet port 4 at the next step 65. At the next step 66, the revolution of the upper fan 1 is set to zero or stoppage. At the next step 67, the revolution of the lower fan 2 is set to $x_3$ rpm. Thus, only the lower fan 2 is driven at the set revolution while the upper outlet port 4 is closed by the damper 24*c***.

As a result, when the "spot mode" is set, the outlet air is blown out of only the lower outlet port 5. The outlet air is blown to around the user exclusively, which allows to cool or heat the user effectively and make the atmosphere around the user comfortable.

Figure 12:
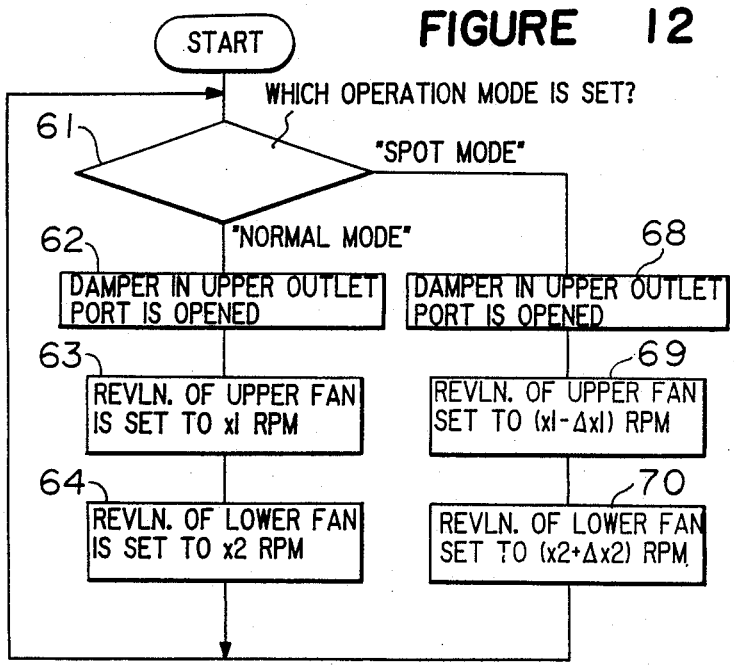
FIG. 12 is a flow chart showing a modified embodiment of the air-blowing control of the fourth embodiment.

Although in the embodiment as just mentioned, the upper fan 1 is stopped at the "spot mode", an air flow control system represented by the flow chart as shown in FIG. 12 can be adopted.

In FIG. 12, when the "normal mode" is selected, the same processing as FIG. 11 is carried out. When the "spot mode" is selected, a different processing is carried out.

If at the step 61 it is determined that the operation mode is the "spot mode", the damper **24*c* in the upper outlet port 4 is opened at the next step 68. At the next step 69, the revolution of the upper fan 1 is set to ($x_1-\Delta x_1$ rpm) which is slower than the revolution at the normal mode ($x_1$ rpm) by $\Delta x_1$ rpm. At the next step 70, the revolution of the lower fan 2** is set to ($x_2+\Delta x_2$) rpm which is faster than the revolution at the normal mode ($x_2$ rpm) by $\Delta x_2$ rpm.

Thus, while both fans 1 and 2 are being driven, the air flow ration of the lower fan 2 to the upper fan is increased to carry out an air flow operation wherein the air flow from the lower fan 2 is more than that from the upper fan 1. Although in this case, the air flow is less concentrated than the case that the upper fan 1 is stopped, there is no significant difference in terms of comfort in the atmosphere around the user. In addition, the upper outlet port opening and closing means can be eliminated because it is not necessary to close the upper outlet port 4.

In accordance with the present invention, the information on the setting of the "strong wind" mode or the "weak wind" mode, the setting of the operation mode such as the "normal mode" and the "spot mode", and the temperature of the upper outlet air is output from the input producing means to the control means. The control means makes it possible to carry out the revolution control, including driving and stopping, of at least both fans among the fans and the upper outlet port opening and closing means. As a result, it is possible to optimize the outlet air from the outlet ports so that the user who is at a lower position than the mounting level of the wall-mounted air conditioner can feel the best comfort. It is also possible to produce optimized comfortable atmosphere as the user wishes.

What is claimed is:

1. In an air flow control device for an air conditioner including a heat exchanger arranged so as to face an inlet port, and upper and lower air-blowing fans disposed in upper and lower outlet ports, respectively, wherein air drawn through the inlet port and the heat exchanger is directed to the fans, the improvement comprising:

outlet air temperature detecting means for detecting the temperature of the outlet air from the lower outlet port and for producing a corresponding output signal;

upper and lower fan operation mode determining means for determining operation modes of said upper and lower fans and producing corresponding commands depending upon the outlet signal from the outlet air temperature detecting means;

upper and lower fan operation mode control means for controlling the operation of both fans at the operation mode according to the commands from the operation mode determining means based on the temperature of the outlet air from said lower outlet port, and means for controlling revolution speeds of said upper and lower fans so that with both said fans being off, when said outlet temperature of said lower fan exceeds a first predetermined temperature threshold, only said lower fan is turned on at a first speed, when said outlet temperature of said lower outlet exceeds a second temperature greater than said first temperature, only said lower fan is turned on at a second speed higher than said first speed, when said outlet temperature of said lower outlet exceeds a third temperature higher than said second temperature, said lower fan is operated at said second speed and said upper fan is operated at a third speed, and when said outlet temperature of said lower outlet exceeds a fourth temperature higher than said third temperature, said lower fan is operated at said second speed and said upper fan is operated at a fourth speed higher than said third speed.

* * * * *